US005342211A

United States Patent [19]

Broeksteeg

[11] Patent Number: 5,342,211

[45] Date of Patent: Aug. 30, 1994

[54] SHIELDED BACK PLANE CONNECTOR

[75] Inventor: Johannes M. Broeksteeg, Hertogsingel, Netherlands

[73] Assignee: The Whitaker Corporation, Wilmington, Del.

[21] Appl. No.: 28,035

[22] Filed: Mar. 8, 1993

[30] Foreign Application Priority Data

Mar. 9, 1992 [GB] United Kingdom ..... 9205088

[51] Int. Cl.[5] ..... H01R 13/658

[52] U.S. Cl. ..... 439/108; 439/608

[58] Field of Search ..... 439/108, 607, 608, 101

[56] References Cited

U.S. PATENT DOCUMENTS

| | | | |
|---|---|---|---|
| 4,836,791 | 6/1989 | Grabbe et al. | 439/81 |
| 4,846,727 | 7/1989 | Glover et al. | 439/608 |
| 4,975,084 | 12/1990 | Fedder et al. | 439/608 |
| 5,046,960 | 9/1991 | Fedder | 439/108 |
| 5,066,236 | 11/1991 | Broeksteeg | 439/79 |
| 5,104,341 | 4/1992 | Gilissen et al. | 439/608 |

FOREIGN PATENT DOCUMENTS

| | | | |
|---|---|---|---|
| 337634 | 10/1989 | European Pat. Off. | 439/608 |
| 3529218 | 2/1986 | Fed. Rep. of Germany . | |
| 3605316 | 8/1987 | Fed. Rep. of Germany . | |
| 4040551 | 4/1993 | Fed. Rep. of Germany . | |

OTHER PUBLICATIONS

IBM Bulletin, "Shielded In-Line Electrical Multiconnector", vol. 10, No. 3, Aug. 1967.

*Primary Examiner*—Gary R. Paumen

*Attorney, Agent, or Firm*—Eric J. Groen; Timothy J. Aberle

[57] ABSTRACT

A shielded back plane connector is disclosed comprising a header assembly and a daughter board connector. The daughter board connector includes an upper and lower shield where the upper and lower shields include stamped windows thereby forming passages for allowing structural ribs of the housing to pass therethrough while providing a contact for contact with grounding pins disposed in the header assembly. A cross talk shield can be positioned intermediate each of the terminal sub-assemblies thereby reducing the cross talk between adjacent terminals. A shield includes a contact portion for contacting the center terminal in the shielded sub-assembly, for using the center terminal as a ground terminal.

18 Claims, 8 Drawing Sheets

SHIELDED BACK PLANE CONNECTOR

BACKGROUND OF THE INVENTION

1. Field of the Invention

The subject invention relates to a shielded back plane connector which can be mounted to a back plane, which receives a shielded daughter card connector.

2. Description of the Prior Art

It is common in electronic architecture to provide for a header connector having a plurality of male pins to be mounted to a mother board connector. A daughter board connector is mounted to a daughter card and is profiled for receipt within the header connector, the daughter board connector having a plurality of receptacle sockets for electrical connection with the male pins in the header.

It is known to provide a shield between the vertical rows of terminals to prevent cross-talk between the vertical columns. For example, as shown in German patent application, DE 40 40 551 C2, a cross-talk shield is placed intermediate the terminal subassemblies which form the connector. One of the drawbacks to the above-mentioned design is that a different terminal subassembly is necessary due to the thickness of the shield itself.

It is an object of the invention then to provide a back-plane connector having a cross-talk shield.

A further object of the invention is to provide for a shielded back plane assembly having overall reduced dimensions, without compromising on other characteristics such as EMI/RFI, signal speed, and the like.

A further object of the invention is to substantially eliminate the cross-talk between adjacent terminals.

The objects were accomplished by providing a high density shielded back plane connector comprising a front housing portion and a plurality of terminal sub assemblies fixed to the front housing. The terminal sub assemblies comprising front mating contact portions positioned in the front housing portion, an intermediate portion moulded in an insulative web of material and a rear contact portion extending from the web of material and adapted for mating with further conductors. A shield portion is positioned intermediate each of the plastic webs where the connector is characterized in that the web includes a reduced thickness of a reduced thickness section in the web on both sides thereof the reduced thickness portion forms a thin membrane over a substantial portion of the intermediate portions thereby increasing the impedance along the intermediate portions interiorly of the shields.

In another aspect of the invention, an electrical connector has a front housing portion and a plurality of contact modules fixed to the front housing, where the contact modules comprise a front mating contact portion positioned in the front housing portion, an intermediate portion molded in an insulative web of material, and a rear contact portion extending from the web of material and adapted for mating with further conductors. The shield member is also positioned intermediate each web. The connector is characterized in that the web includes a recessed surface profiled for receiving the shield member thereagainst, whereby a plurality of contact modules maybe stacked one against the other, with or without a shield member therebetween, such that the stacking thickness of the modules remains constant.

BRIEF DESCRIPTION OF THE DRAWINGS

FIG. 6 is a cross-sectional view through lines 6—6 of FIG. 5;

DETAILED DESCRIPTION OF THE PREFERRED EMBODIMENT

Figure 1:
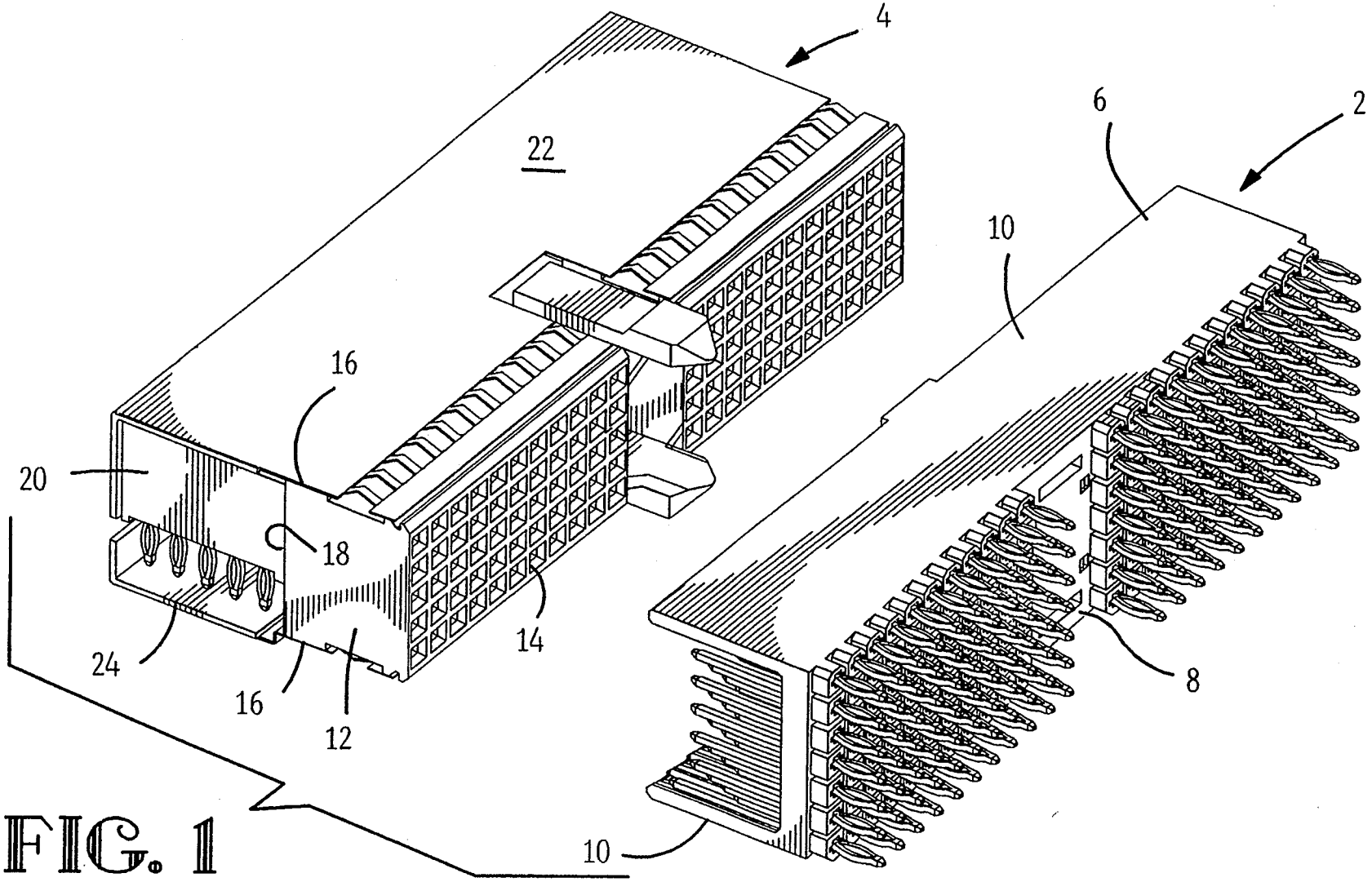
FIG. 1 is an isometric view of the shielded daughter board connector exploded from the complementary header.

FIG. 1 is an isometric view of a header connector shown generally at 2 and a shielded daughter card connector shown generally at 4. The header assembly 2 is generally comprised of an insulating housing 6 having a lower surface 8 for mounting to a mother board and side walls 10 upstanding from the floor portion 8. With reference still to FIG. 1, the daughter board connector 4 is generally comprised of a forward housing portion 12 having a front mating face 14 side surfaces 16 and a rear surface 18. A plurality of terminal sub-assemblies 20 are shown assembled to the housing 12 and encapsulated in upper and lower shield members 22, 24 respectively.

Figure 2:
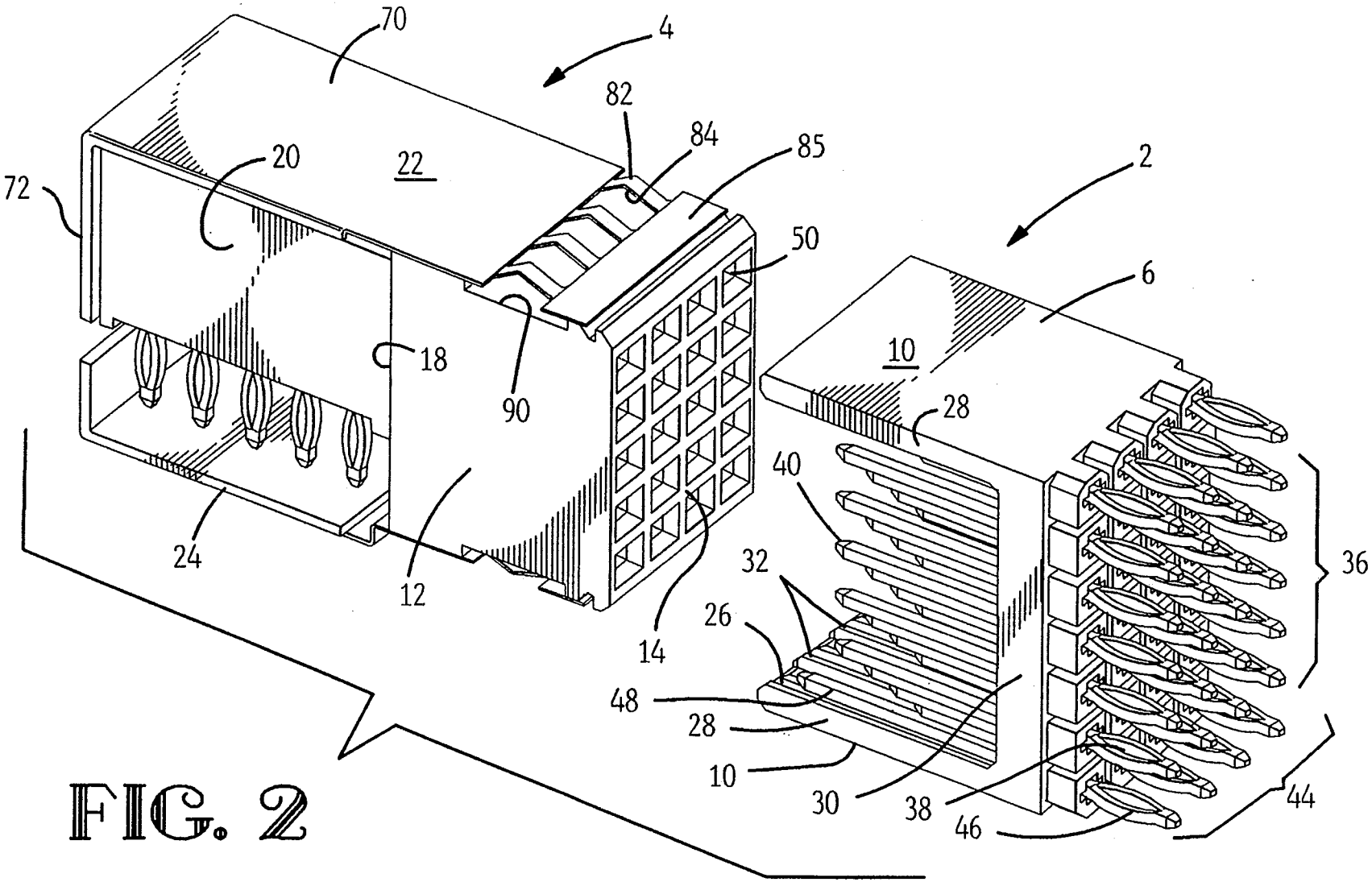
FIG. 2 is an isometric view of an enlarged section of the connectors shown in FIG. 1.

With reference now to FIG. 2, the header assembly 2 and daughter board assembly will be described in greater detail, where FIG. 2 is an enlarged section of the assemblies shown in FIG. 1. As shown in FIG. 2, the header housing 6 has side walls 10 comprised of thin side wall sections 26 having end strengthening ribs 28 and 30. Along the interior length of the thin side wall section 26, a plurality of strengthening ribs 32 are positioned integral with the sidewall 10 to rigidify these thin side wall sections. The header assembly 2 further comprises a plurality of signal contacts 36 having compliant pin portions 38 extending outwardly from the floor 8 and further include male pin portions 40 positioned within the header intermediate the side walls 10. The header assembly 2 further comprises a plurality of grounding contacts 44 having compliant pin portions 46 and a grounding pin portion 48 positioned between strengthening ribs 32.

Figure 3:
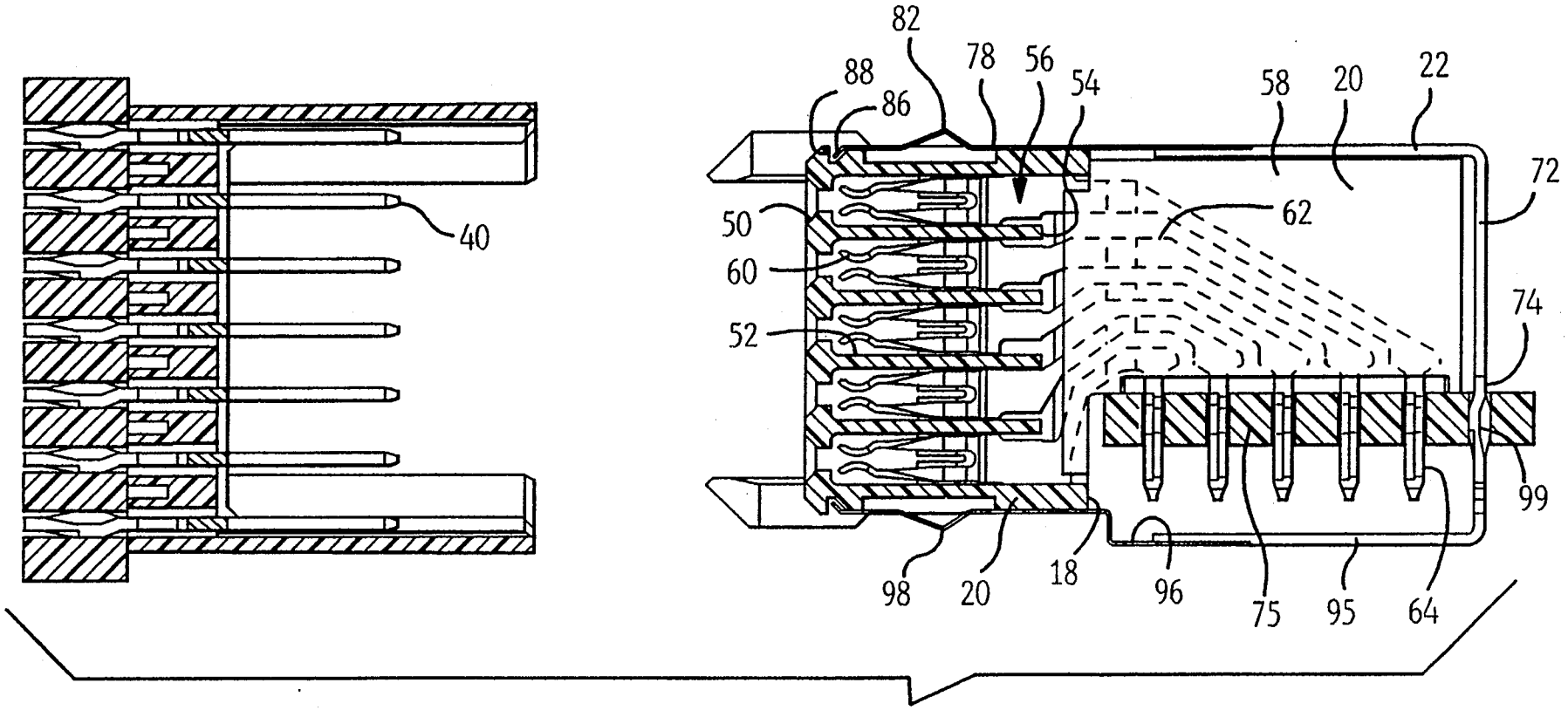
FIG. 3 is a cross-sectional view through the connector of FIG. 1 or 2 showing the internal structure thereof.

With reference now to FIGS. 2 and 3, the daughter board connector 4 will be described in greater detail. Housing 12 includes a plurality of signal pin contact receiving openings shown at 50 leading into a terminal receiving passageway 52, the passageway 52 extending rearwardly to a face 54. A plurality of terminal subassemblies 20 are positioned against the housing 12 where each subassembly includes a plurality of electrical terminals 56 encapsulated in an overmoulded web of plastic material 58. Each contact 56 includes a receptacle portion 60 for mating contact with one of the male signal pins 40 and further comprises an intermediate portion 62, which interconnects the receptacle portions to and compliant pin portions 64.

With reference again to FIG. 2, the upper shield 22 includes an upper plate portion 70 for positioning above the housing portion 12 and above the terminal subassemblies 20. The upper shield member 22 further includes a rear plate portion 72 for positioning behind the terminal subassemblies 20, the rear plate portion 72 including a plurality of integral compliant pin sections 74 for mechanical and electrical connection to a printed circuit board 75, as shown in FIG. 3. The upper shield member 22 further includes a thin plate portion 78 (FIG. 3) formed by a premilling operation to reduce the thickness of the shield portion over the housing 20 to reduce the overall width dimension of the shielded data board connection. As shown in FIG. 2, the upper shield 22 is kinked adjacent to the front mating face 14 to form projections 82 extending above the plane formed by the upper plate portion 70. A plurality of windows 84 are stamped from the upper plate portion 70 whereby the windows are laterally positioned to receive the strengthening ribs 32 therein, while the projections 82 form shield contacts, which span the strengthening ribs 32, for mating with the ground pins 48. To rigidify the plurality of shield contacts 82 a strengthening strap 85 extends transversely of the shields contacts 82 and is held to the housing by a folded front edge 86 positioned in a laterally extending groove 88 (FIG. 3). To improve the resiliency of the shield contacts 82 a laterally extending channel 90 is positioned below the shield contacts 82. The lower shield member 24 is similar to the upper shield portion including a plate portion 95 having a thin wall section 96, shield contacts at 98, and compliant portions 99 for interconnection to the printed circuit board.

Figure 4:
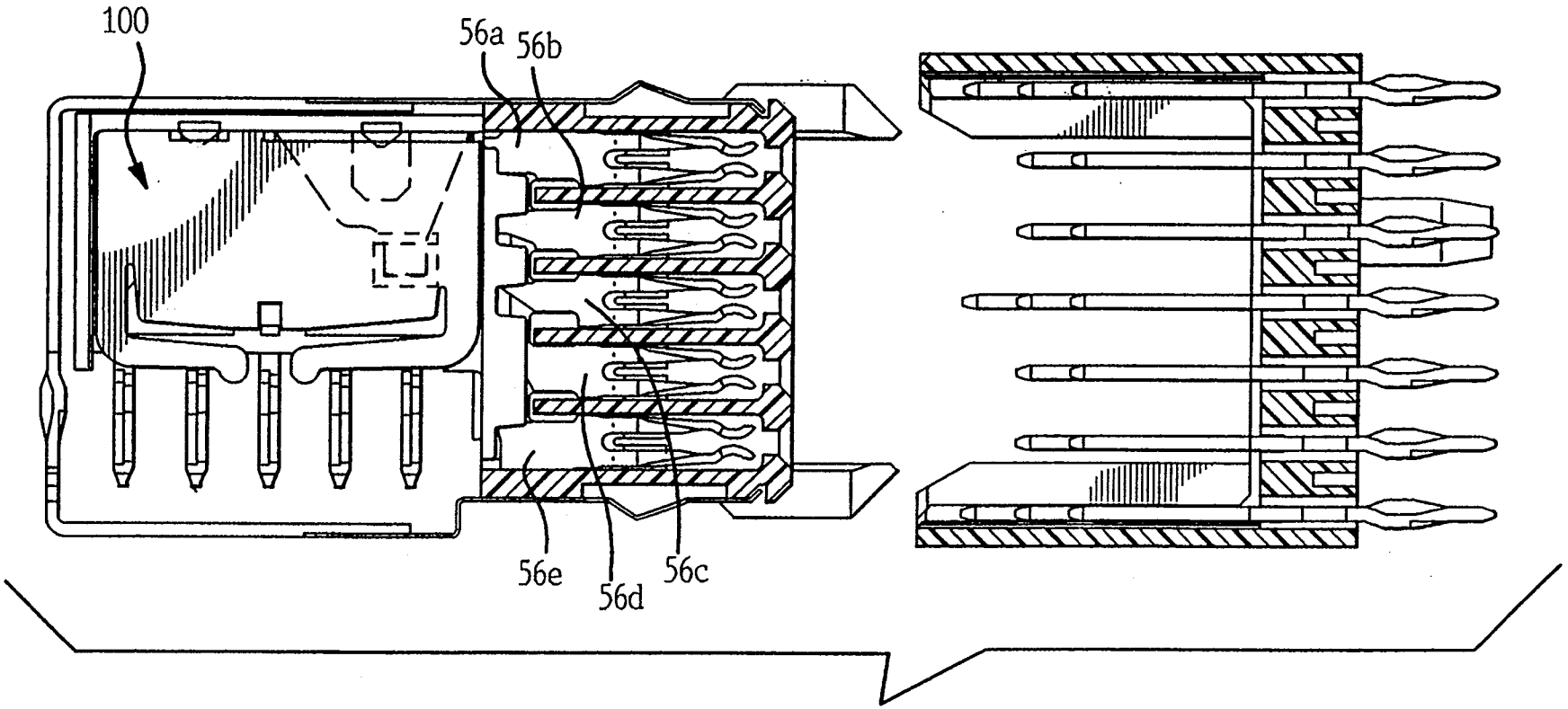
FIG. 4 is a cross-sectional view similar to that of FIG. 3 showing an alternate embodiment having a cross talk shield.

With reference now to FIG. 4, the above mentioned daughter board connector 4 can alternatively be used with an additional shield placed intermediate the plurality of terminal sub-assemblies 20 to reduce the cross talk between the adjacent terminal strips. For this purpose, a cross talk shield 100 can be positioned between each adjacent stacked terminal sub-assembly 20. In the preferred embodiment of the invention the cross talk shield 100 contacts the center terminal 56C leaving terminals 56A, 56B and 56D, 56E for signal contacts thereby forming a modified strip line connector.

Figure 8:
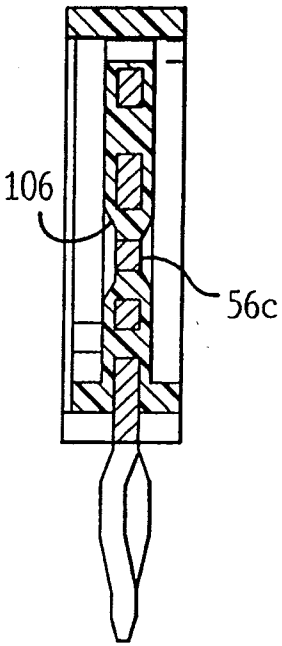
FIG. 8 is a plan view of the cross talk shield in a stamped blank form.
Figure 5:
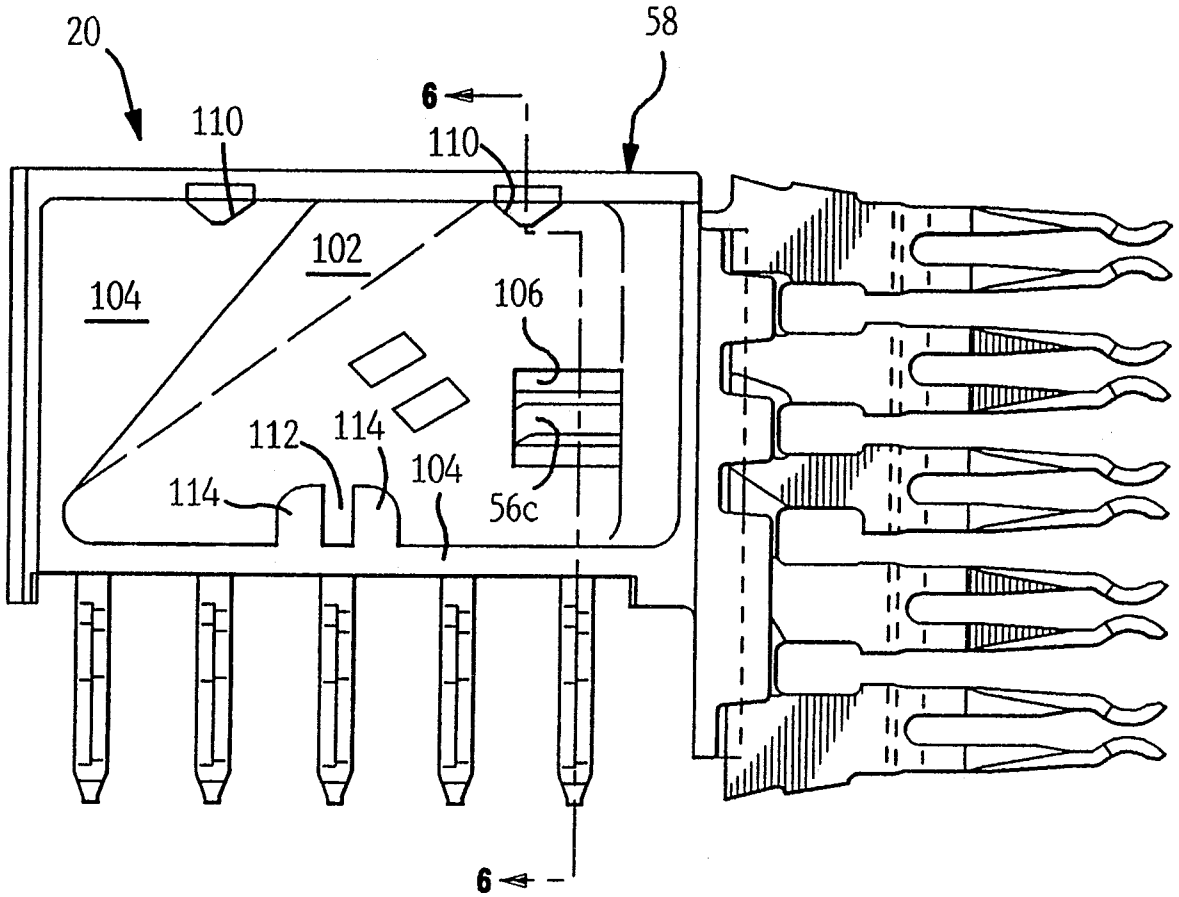
FIG. 5 is a side plan view of the terminal sub-assembly for use in the embodiment of FIG. 4.
Figure 7:
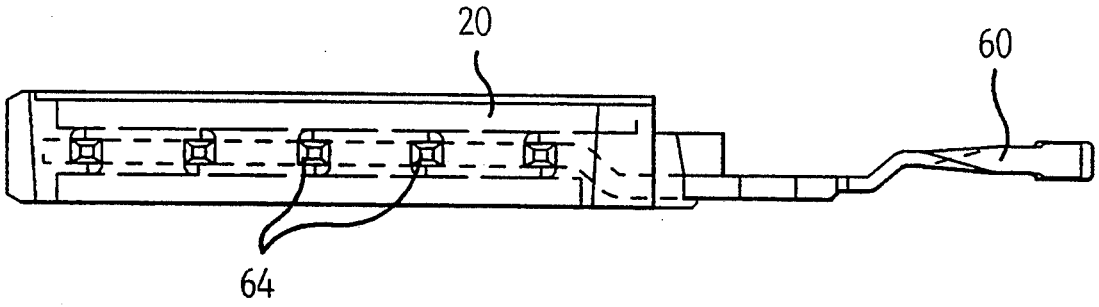
FIG. 7 is a lower plan view of the terminal sub-assembly shown in FIG. 5.
Figure 8:
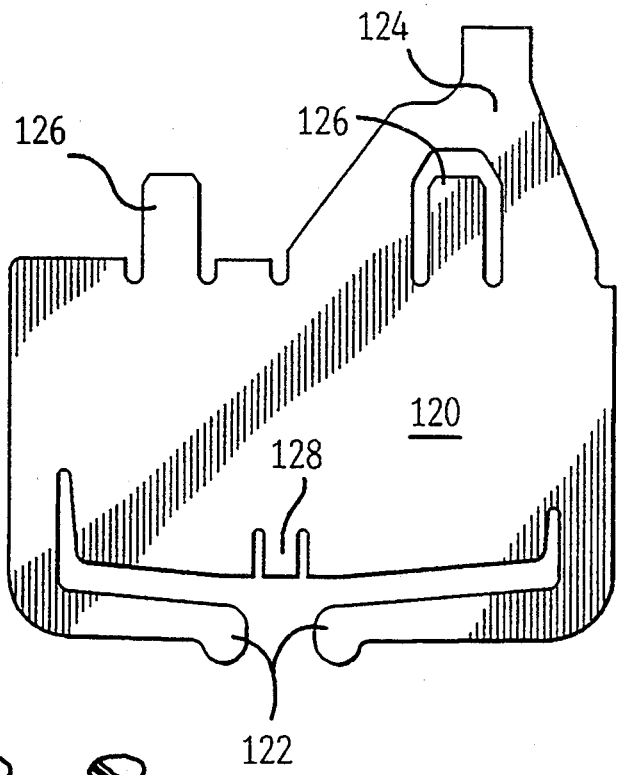
Figure 10:
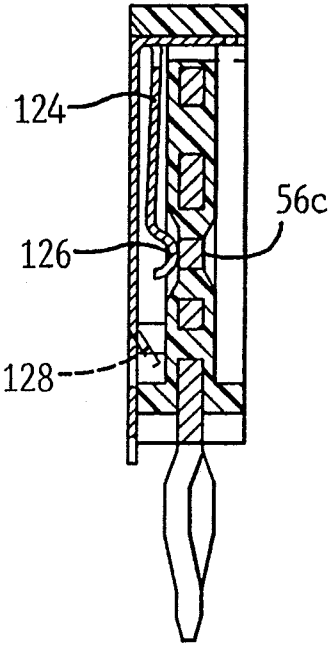
FIG. 10 shows a cross-sectional view of the terminal sub-assembly through lines 10—10.
Figure 9:
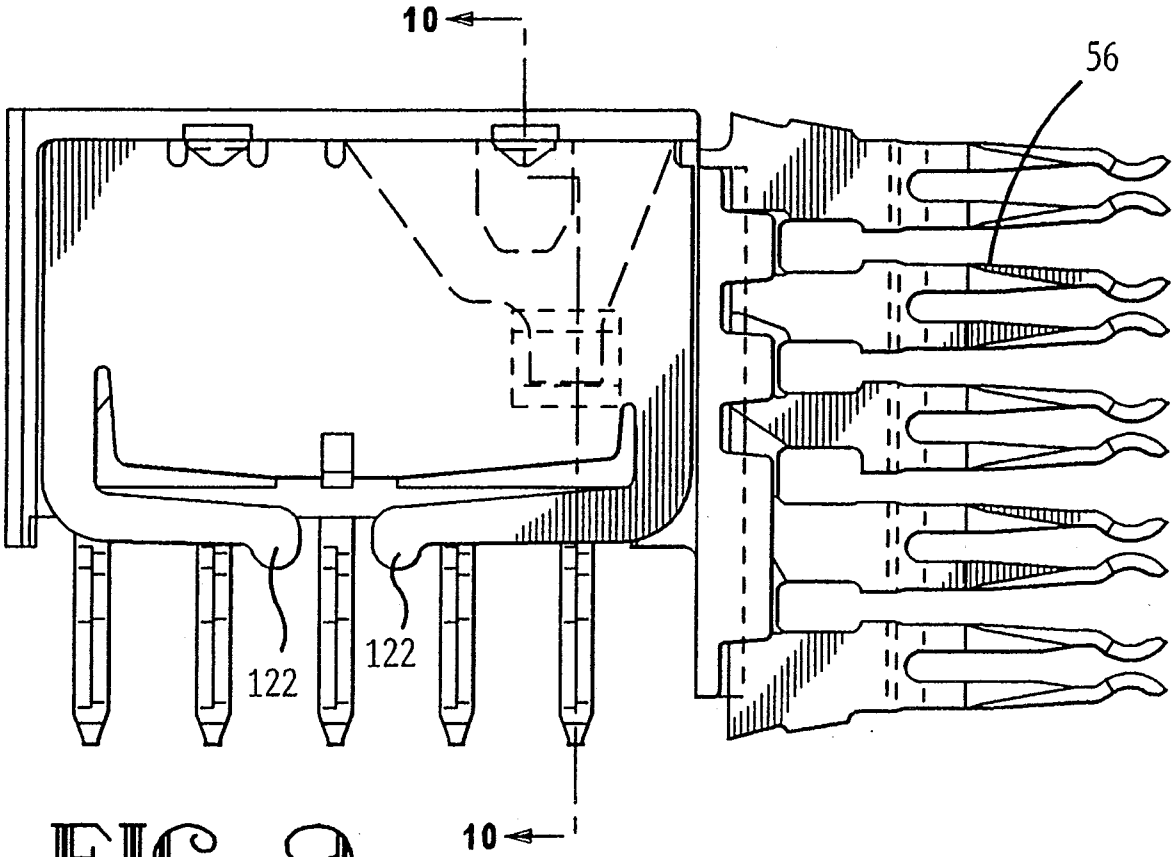
FIG. 9 is a side plan view showing the cross talk shield in place on the terminal sub-assembly.
Figure 11:
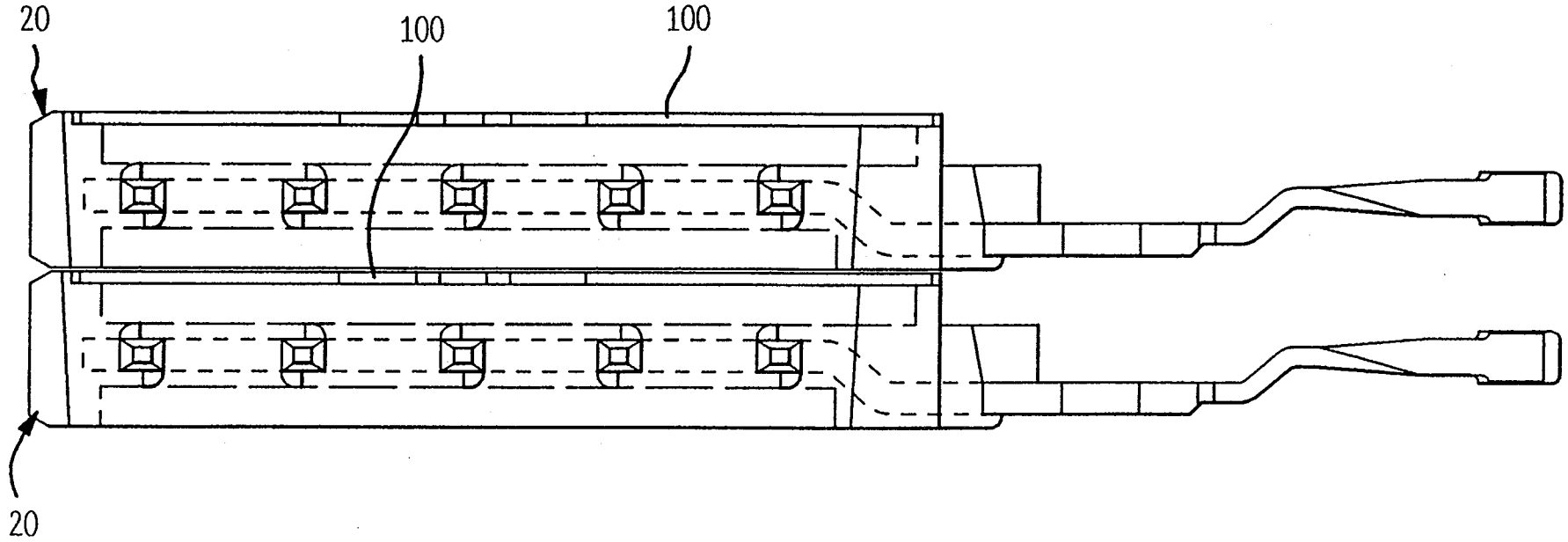
FIG. 11 shows a lower plan view of two of the sub-assemblies stacked together with the cross talk shield in place.

With reference now to FIG. 5, the shielded subassembly 20 will be described in greater detail for use with the cross talk shield. As mentioned above, the terminal sub-assembly 20 has an overmoulded web of material 58 having a recessed pocket at 102 and a recessed surface 104. As shown in FIGS. 5 and 6, a window is formed at 106 exposing a portion of the central terminal 56C for contacting with the cross talk shield 100. With reference again to FIG. 5, two apertures are formed through the insulating web 58 at 110 and a lower slot 112 is formed by two upstanding ribs 114 having a thickness equal to the raised portion 104 with the intermediate portion between the slot being recessed to the surface 102. With reference now to FIG. 8, the cross talk shield 100 has a flat plate portion 120 including two lower contact arms 122 for contact with a trace on a printed circuit board, and further comprises an upper contact arm shown at 124. The cross talk shield 100 further comprises locking tabs 126 at an upper edge thereof, and locking tab 128 at a lower edge thereof. As shown in FIG. 10, the cross talk shield is formed with the contact arm 124 bent around an upper edge of the flat plate portion 122, and the end of the contact arm 124 is formed with a radius section thereby forming a contact surface 126 for contacting the central contact 56C. FIG. 10 also shows cross-talk shield positioned on the surface 104, with the cooperation between the tabs 126 within the openings 110, and shows the tab 128 frictionally held between the two upstanding ribs 114 in the slot thereof. As shown in FIGS. 10 and 11, a plurality of cross talk shields 100 can be placed against the terminal sub-assemblies 20 to reduce the cross talk between adjacent terminal sub-assemblies. The cross-talk shields can be added without increasing the stack thickness of the terminal sub-assemblies and the shields 100, as the shields are positioned against the recessed surface 104.

Advantageously then, as the center line distance between adjacent terminals in adjacent terminal subassemblies 20 has been reduced by half, by the addition of the cross talk shield 100, the impedance has been increased by the formation of the recessed surface 102, thereby providing a pocket of air adjacent to the terminals. Furthermore the ground signal path has been reduced by providing two contact arms 122 adjacent to the daughter board and by providing the contact to the centre terminal 56C. Moreover, as shown in FIG. 11, the modules 20 can be stacked one against the other with the shield member therebetween. Due to the recessed area 104, which is profiled to receive the shield 100, the stacking thickness of the modules 20, remains the same, with or without the shields 100 therebetween. Thus, the connector system described above can be used without the cross talk shields 100, without having to change the contact modules 20.

I claim:

1. An electrical connector having a front housing portion and a plurality of terminal subassemblies fixed to said front housing, the terminal subassemblies comprising a front mating contact portion positioned in said front housing portion, an intermediate portion moulded in an insulative web of material, and a rear contact portion extending from said web of material and adapted for mating with further conductors, and a shield portion positioned intermediate each said web, said connector being characterized in that:

said web includes a reduced thickness section of insulative material therein, said material being disposed on both sides of said intermediate portions of said contact thereby forming a thin membrane of said insulative material over a substantial portion of said intermediate portions of said contacts, thereby forming a pocket of air between said intermediate portions and said shield portion;

whereby impedance is increased along the intermediate portions of said contacts, interiorly of said shields.

2. An electrical connector according to claim 1, characterized in that, said web includes a window therethrough exposing one of said intermediate portions of one select terminal, and said shield includes a resilient contact portion for contacting said selected intermediate portion.

3. An electrical connector according to claim 2, characterized in that said resilient contact portion is formed from a reversely bent contact leg which extends integrally from said shield.

4. An electrical connector according to claim 2, characterized in that the resilient contact portion is formed by a portion extending from one edge of said shield.

5. An electrical connector according to claim 1, characterized in that said connector includes five electrical terminals positioned in each of said subassemblies.

6. An electrical connector according to claim 1, characterized in that said terminals are arranged in two pairs of signal contacts with an intermediate contact being associated therewith to ground said shield.

7. An electrical connector according to claim 1, characterized in that said connector is profiled as a right angled connector where said rear mating contact portions extend from said web at a substantial right angle relative to said front mating contact portions, said webs including a lower edge profiled for receiving a printed circuit board thereagainst.

8. An electrical connector according to claim 7, characterized in that said shield includes a second resilient contact portion extending below said web lower edge, for contacting a ground plate on said printed circuit board.

9. An electrical connector according to claim 1, characterized in that said shield includes two resilient contact arms extending from a lower edge thereof, profiled to contact a grounding pad on a printed circuit board.

10. An electrical connector having a front housing portion and a plurality of contact modules fixed to said front housing, the contact modules each comprising a front mating contact portion positioned in said front housing portion, an intermediate portion moulded in an insulative web of material, and a rear contact portion extending from said web of material and adapted for mating with further conductors, and a shield member positioned intermediate each said web, said connector being characterized in that each said web includes a recessed surface profiled for receiving the shield member thereagainst whereby a plurality of contact modules may be stacked one against the other, with or without a shield member therebetween, and the stacking thickness of the modules remains constant.

11. An electrical connector according to claim 10, characterized in that, said web includes a window therethrough exposing one of said intermediate portions of one select terminal, and said shield includes a resilient contact portion for contacting said selected intermediate portion.

12. An electrical connector according to claim 11, characterized in that said resilient contact portion is formed from a reversely bent contact leg which extends integrally from said shield.

13. An electrical connector according to claim 11, characterized in that the resilient contact portion is formed by a portion extending from one edge of said shield.

14. An electrical connector according to claim 10, characterized in that said connector includes five electrical terminals positioned in each of said subassemblies.

15. An electrical connector according to claim 10, characterized in that said terminals are arranged in two pairs of signal contacts with an intermediate contact being associated therewith to ground said shield.

16. An electrical connector according to claim 10, characterized in that said connector is profiled as a right angled connector where said rear mating contact portions extend from said web at a substantial right angle relative to said front mating contact portions, said webs including a lower edge profiled for receiving a printed circuit board thereagainst.

17. An electrical connector according to claim 16, characterized in that said shield includes a second resilient contact portion extending below said web lower edge, for contacting a ground plate on said printed circuit board.

18. An electrical connector according to claim 10, characterized in that said shield includes two resilient contact arms extending from a lower edge thereof, profiled to contact a ground pad on a printed circuit board.

* * * * *